US007517078B2

(12) United States Patent
Kan et al.

(10) Patent No.: US 7,517,078 B2
(45) Date of Patent: Apr. 14, 2009

(54) IMAGE FORMING APPARATUS

(75) Inventors: Shoichi Kan, Yokohama (JP); Yasuyuki Asai, Tokyo (JP); Tetsuya Saito, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 348 days.

(21) Appl. No.: 11/127,156

(22) Filed: May 12, 2005

(65) Prior Publication Data

US 2005/0264634 A1 Dec. 1, 2005

(30) Foreign Application Priority Data

May 14, 2004 (JP) ..... 2004-145071
Jun. 9, 2004 (JP) ..... 2004-171279

(51) Int. Cl.
*B41J 2/01* (2006.01)

(52) U.S. Cl. ..... 347/104; 271/9.01; 271/9.09; 271/18; 358/498; 358/505; 399/75; 399/131; 399/167; 399/367; 399/374; 400/188; 400/624; 400/625

(58) Field of Classification Search ..... None
See application file for complete search history.

(56) References Cited

U.S. PATENT DOCUMENTS 5,730,537 A * 3/1998 Kelly et al. ..... 400/625
5,807,003 A * 9/1998 Kobayashi et al. ..... 400/625
6,167,231 A * 12/2000 Blackman et al. ..... 399/364
6,685,294 B2 2/2004 Gaasch et al.
6,966,714 B2 * 11/2005 Harris et al. ..... 400/188
7,222,955 B2 * 5/2007 Ohashi et al. ..... 347/104
2002/0124746 A1 * 9/2002 Mogi ..... 101/227
2004/0086310 A1 * 5/2004 Eskey ..... 399/401
2006/0044377 A1 * 3/2006 Johnson et al. ..... 347/104

FOREIGN PATENT DOCUMENTS

JP 5-33157 4/1993
JP 2002-321414 11/2002
JP 2003-40505 2/2003

OTHER PUBLICATIONS

Notification of First Office Action in Chinese Patent Application No. 2005100680973.5, dated Dec. 7, 2007.

* cited by examiner

*Primary Examiner*—Luu Matthew
*Assistant Examiner*—John P Zimmermann
(74) *Attorney, Agent, or Firm*—Fitzpatrick, Cella, Harper & Scinto

(57) ABSTRACT

An ink jet recording apparatus includes a sheet feeding tray, a sheet discharge tray, an image recording portion including an ink jet recording head and a platen, a sheet feeding roller, a first roller portion, disposed between the sheet feeding tray and the image recording portion, and a second roller portion, disposed at a position across the image recording portion from the first roller portion. After the recording material fed from the sheet feeding tray is passed between the ink jet recording head and the platen and is nipped by the first roller portion, recording is carried out when the recording material is fed in an opposite direction between the ink jet recording head and the platen.

13 Claims, 14 Drawing Sheets

IMAGE FORMING APPARATUS

FIELD OF THE INVENTION AND RELATED ART

The present invention relates to an image forming apparatus, in particular, to an image forming apparatus of the switch-back recording medium conveyance type, which receives recording medium from one side of the main assembly of the apparatus, and discharges the recording medium out of the same side after the recording of an image on the recording medium.

An ink jet recording apparatus, which is one of the widely known image forming apparatuses, is in use in a printer, a copying machine, or the like, because it is low in noise, low in cost, easier to reduce in size, easier to colorize, or the like reasons.

In recent years, a digital camera has come to be widely used, and therefore, the consumer demand for a means for easily printing a photographic image at home has increased. As one of the answers to this demand, a photo printer has been devised, which is capable of printing a photographic image of A6 size (equivalent to size of ordinary photograph or post-card), without involving a computer, that is, directly from a memory card or a digital camera itself.

In consideration of the diversity in the users and usages (positioning of printer) generally, an A6 size printer is structured so that it can be controlled from the front side, that is, recording medium is fed into the printer from the front side and is discharged frontward of the printer. The switch-back recording medium conveyance system is one of the recording medium conveyance systems employed to realize an image forming apparatus such as the above described one, from the front side of which recording medium is fed into the apparatus for image formation, and then, is discharged therefrom through virtually the same path as the path, through which the recording medium is fed into the apparatus, after image formation.

Generally, a printer of the frontal-feed and frontal-discharge type such as the above-mentioned one is structured so that its recording paper feeding mechanism, in which a single or plurality of recording papers are stored in layers, is disposed on the front side, and its recording paper discharging mechanism, into which recording papers are discharged in layers after recording, is disposed immediately above the recording paper feeding mechanism (immediately next thereto, if printer is of upright type).

As described above, in the case of a printer of the frontal-feed and frontal-discharge type, its recording paper feeding-discharging mechanism is on the front side of the printer, and its image recording portion is on the rear side of the printer. Therefore, a printer in accordance with the prior art suffers from the following problem. That is, as soon as the trailing end of a recording paper is released from the grip of a pair of rollers, as a recording paper conveying means, of the image recording portion, there is no force available to further convey the recording paper. Therefore, the operation for discharging a recording paper sometimes ends while the trailing end of the recording paper is still in the adjacencies of the pair of rollers and on the paper feeding mechanism. If the next paper feeding operation is started while the printer is in the above described state, it is possible that the recording paper on which an image has just been formed will be pulled back into the apparatus, and/or that as the next recording paper is conveyed into the apparatus from the paper feeding mechanism, the conveyance of this recording paper will be interfered with the preceding recording paper on which an image has been recorded, resulting in a paper jam or the like.

Moreover, according to the prior art, in order to discharge a recording paper with the use of a part of the means for feeding a recording paper while separating it from the rest of the recording papers in the recording paper feeding mechanism, the cam portion for controlling the paper separation and paper feeding has to be provided with the portion for controlling the paper discharge, necessitating the increase in the size of the control cam. Further, in order to intermittently move the control cam, a recording paper path switching means, the action of which is triggered by the carriage movement, must be provided, and also, the position at which the switching is made must be provided. This places a limitation on the reduction in size of the printer.

SUMMARY OF THE INVENTION

The present invention provides an image forming apparatus of the front-loading and front-discharging type, which is superior in operability, smaller in size, and also, more stable in the paper feeding operation as well as paper discharging operation, compared to an image forming apparatus of the front-loading and front-discharging type in accordance with the prior art.

According to an aspect of the present invention, there is provided an image forming apparatus for forming an image on a recording material by an image recording portion, said image forming apparatus comprising a sheet feeder for stacking a plurality of recording materials; a sheet feeding roller for contacting the recording material at a first position to feed the recording material from said sheet feeder toward said image recording portion and for contacting the recording material at a second position different form said first position to discharge the recording material; separating means for contacting the sheet feeding roller at the first position to separate the recording material; a pair of rollers, disposed between said sheet feeding roller and said image recording portion, for feeding the recording material to said image recording portion and for discharging the recording material which has been subjected to a recording operation of said image recording portion from said image recording portion; and changing means for changing a discharging direction of the recording material toward the second position of said sheet feeding roller.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Figure 1:
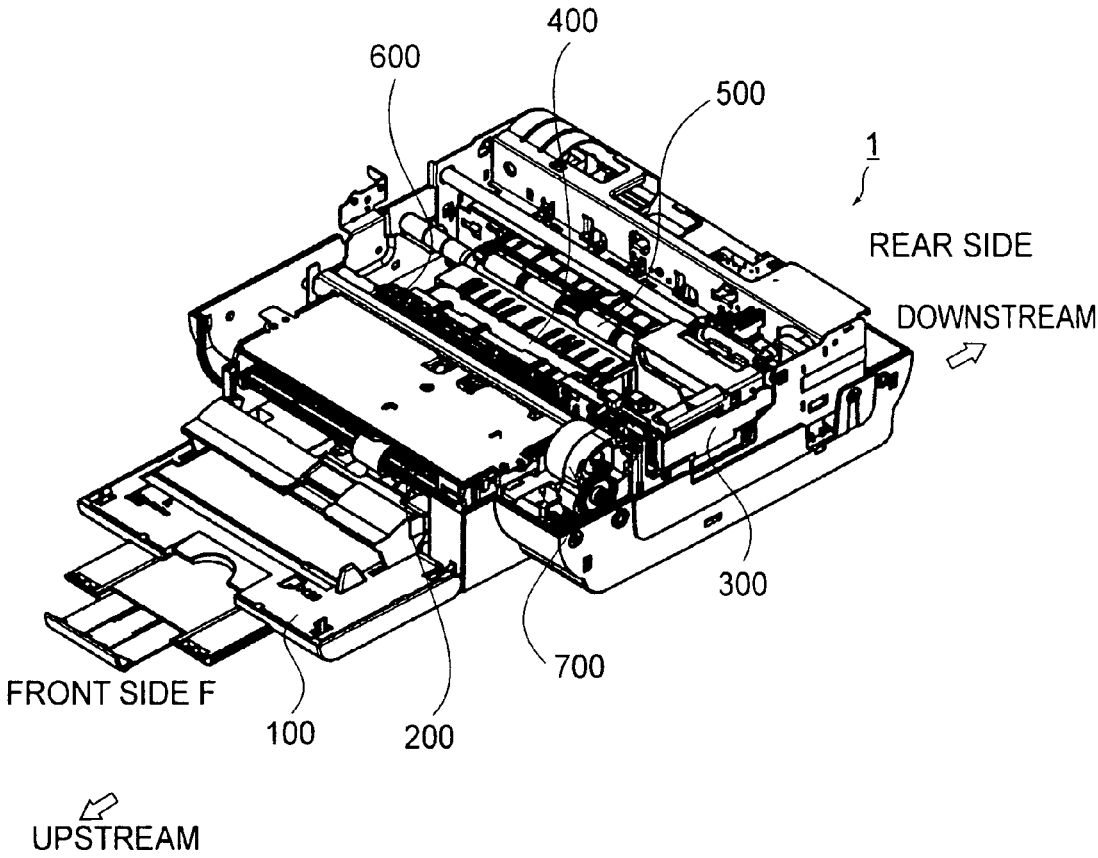
FIG. 1 is a perspective view of the ink jet printer in the first embodiment of the present invention, depicting the general structure thereof.

Hereinafter, the preferred embodiments of the present invention will be described with reference to the appended drawings. FIG. 1 is a perspective view of the ink jet printer in the first embodiment of the present invention, showing the general structure thereof.

The ink jet printer 1 comprises: a paper feeding/discharging tray portion 100 in which a plurality of unrecorded recording mediums P are storable in layers; a sheet separating-feeding-discharging portion 200 (which hereinafter will be referred to as paper conveyance management portion) which not only separates the recording mediums P one by one and conveys them to an image recording portion 400, but also, discharges the recording mediums P into the paper feeding/discharging tray portion 100; a recording means 300 which has an ink jet recording head and forms an image on the recording medium P; and an image recording portion 400 which constitutes a part of the recording medium conveyance path, and in which an image is formed on the recording medium P by the opposing recording means 300. The ink jet printer 1 also comprises: a second roller portion 600 disposed upstream of the image recording portion 400 in terms of the direction in which the recording medium P is fed into the printer 1; a first roller portion 500 disposed on the downstream side of the second roller portion 600; and a driving force transmitting portion 700. The driving force transmitting portion 700 has a driving force source for generating the driving force for driving the paper conveyance management portion 200, and a driving force transmission path through which the driving force is transmitted to the paper conveyance management portion 200.

In the following description of the preferred embodiments of the present invention, the side on which the paper feeding/discharging tray portion 100 is disposed will be referred to as front side (operator side) F of the ink jet printer 1. Further, the front side F of the ink jet printer 1 is referred to as the upstream side, and the rear side will be referred to as the downstream side. As for the placement of recording mediums P into the paper feeding/discharging tray portion 100 and the discharging of the recording medium P into the feeding/discharging tray portion 100 after recording, they are performed on the front side F of the ink jet printer 1.

Figure 2:
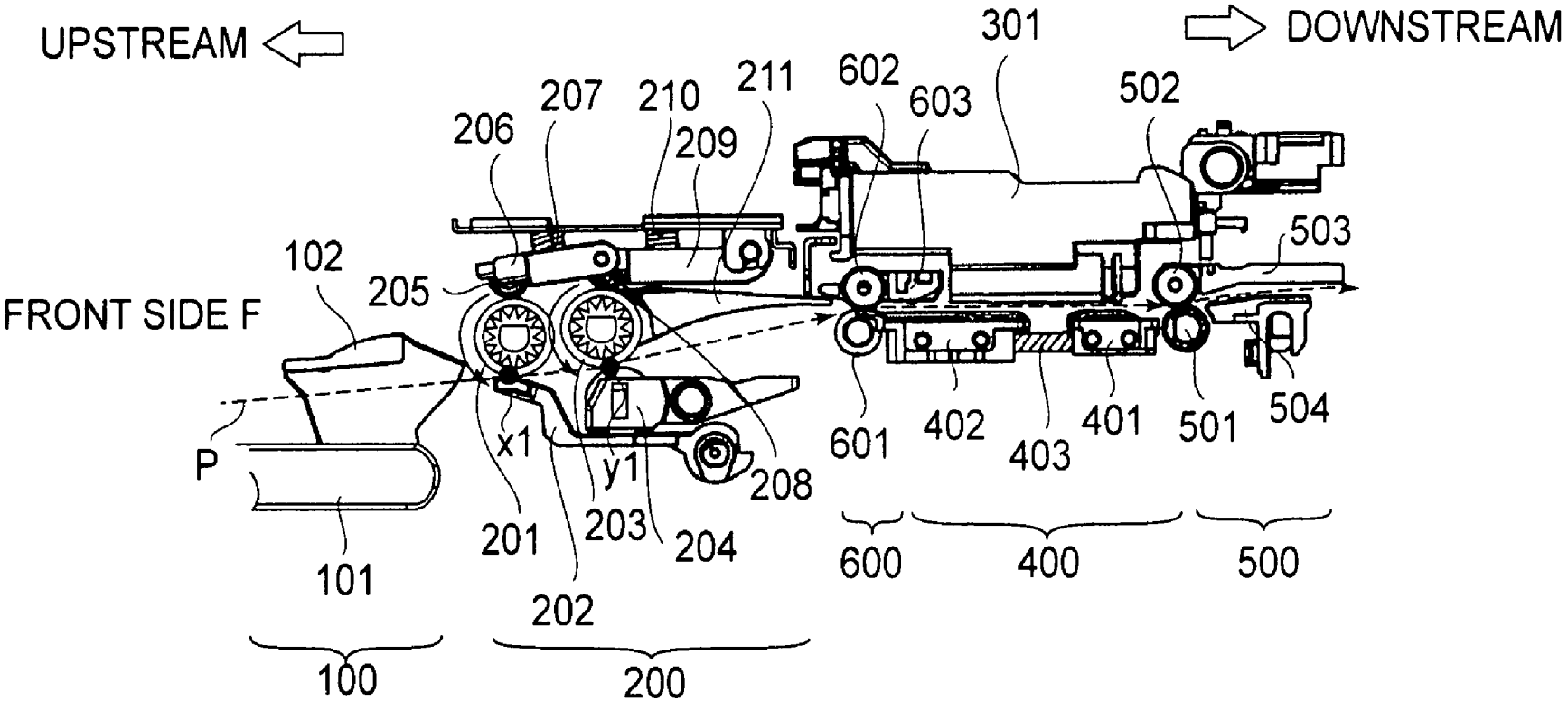
FIG. 2 is a side view of the essential portion of the ink jet printer shown in FIG. 1, depicting general structure thereof.
Figure 3:
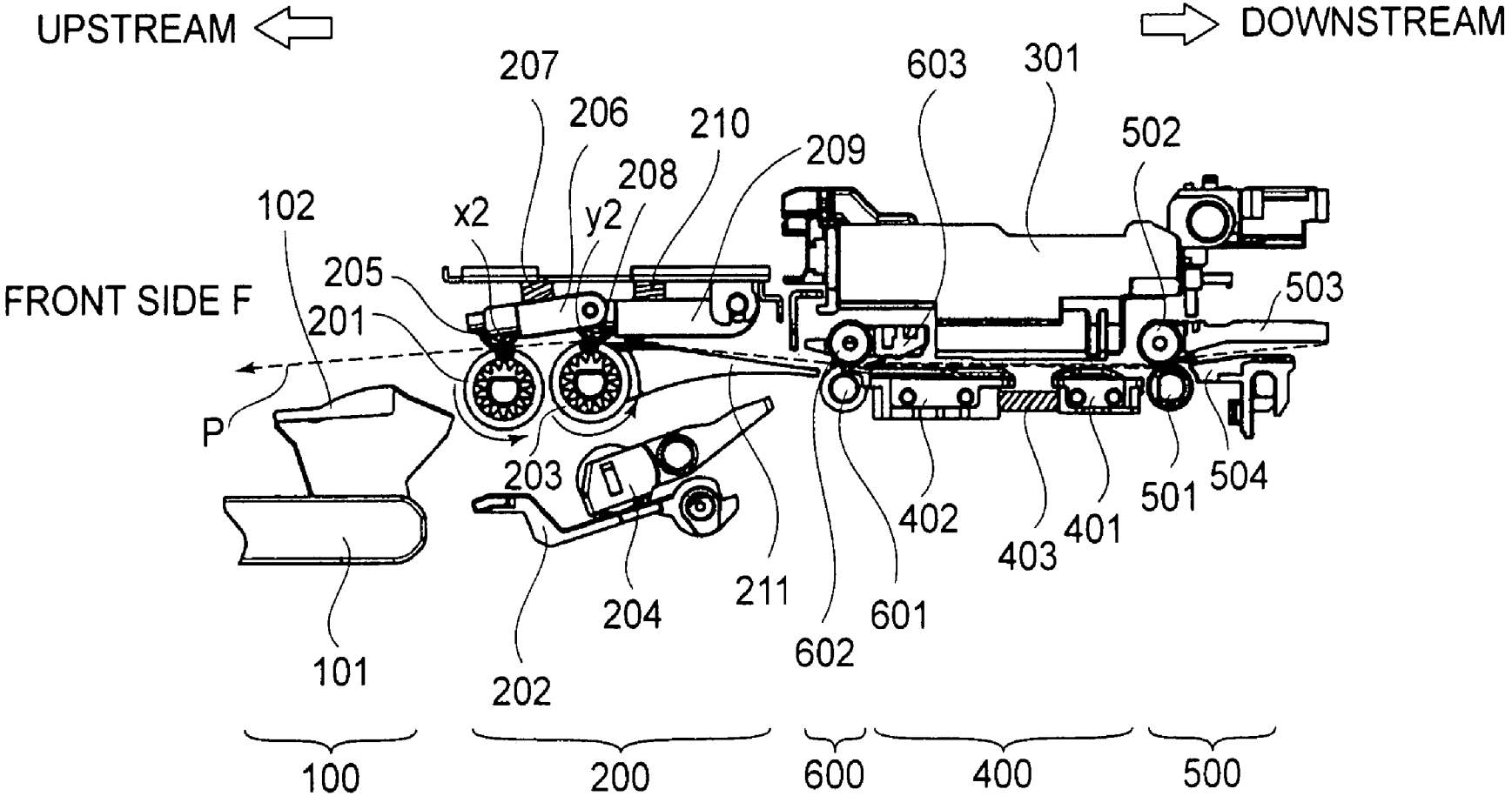
FIG. 3 is also a side view of the essential portion of the ink jet printer shown in FIG. 1, depicting the general structure thereof.

FIGS. 2 and 3 are side views of the abovementioned essential portion of the ink jet printer 1. FIG. 2 shows the essential portion by which the recording medium P is being fed into the ink jet printer 1, and FIG. 3 shows the essential portion by which the recording medium is being discharged from the ink jet printer 1. In FIGS. 2 and 3, the broken lines represent the recording medium path, and arrow marks represent the recording medium conveyance direction. Also in FIGS. 2 and 3, the left side is the front side F.

The paper feeding/discharging tray portion 100 on the front side F has a paper feeder tray 101, and a paper delivery tray 102 in which the recording medium P is held after recording.

The paper conveyance management portion 200 comprises: a pickup roller 201 which draws the recording medium P stored in layers in the paper feeder tray 101, by coming into contact with the recording medium P at a first position x1; a pressure plate 202 which presses the recording medium P on the pickup roller 201 at the first position x1; a feed roller 203 which conveys the recording medium P to the image recording portion 400, by coming into contact with the recording medium P at a first position y1; and a separation mechanism 204 which separates the recording mediums P one by one, by pinching the recording mediums P between itself and the feed roller 203 at the first position y1 if two or more recording mediums P are conveyed thereto at the same time.

The paper conveyance management portion 200 also has a second discharge roller 205 and first discharge roller 208, which are disposed on the opposite sides of the first positions from the pickup roller 201 and feed roller 203. The second discharge roller 205 and first discharge roller 208 are kept pressed upon the pickup roller 201 and feed roller 203, and are rotated by the rotation of the pickup roller 201 and feed roller 203, respectively. The second discharge roller 205 is kept pressed upon the pickup roller 201 at the second position x2, and the first discharge roller 208 is kept pressed upon the feed roller 203 at the second position y2 (FIG. 3). The second and first discharge rollers 205 and 208 are supported by second and first discharge roller holders 206 and 209, respectively, and are kept pressed by the second and first discharge roller springs 207 and 210, respectively. Incidentally, the second and first discharge rollers 205 and 208, second and first discharge roller holders 206 and 209, and second and first discharger roller springs 207 and 210 are sometimes together called the pressing means.

On the downstream side of the feed roller 203, a flapper 211 is disposed, which is switched in position, based on whether the recording medium P is to be fed into the recording apparatus or to be discharged from the recording apparatus. When the recording medium P is to be fed into the recording apparatus, the flapper 211 is pivoted upward so that the recording medium P is guided to the image recording portion 400 after being conveyed to the flapper 211 past the first positions x1 and y1. When the recording medium P is to be discharged, the flapper 211 is pivoted downward so that the recording medium P is guided toward the second positions x2 and y2; it is switched in position to change the direction (in terms of vertical direction, that is, diagonally upward or diagonally downward) in which the recording medium P is to be conveyed.

The image recording portion 400 is provided with an downstream platen 401, an upstream platen 402, and an ink absorbing member 403 disposed between the two platens 401 and 402 to catch the ink when the ink jet printer 1 is in the borderless print mode. The two platens 401 and 402 are disposed to support the recording medium P in a manner to make the recording medium P oppose a carriage 301 which carries the ink jet recording head. They also constitute a part of the recording medium conveyance path.

On the upstream side of the upstream platen 402, more specifically, between the feed roller 203, and image recording portion 400, a discharge roller 601 and a discharge pinch roller 603, are disposed, which together constitute the second roller portion 600. The discharge pinch roller 602 is held by a discharge pinch roller holder 603 so that the discharge pinch roller 602 is kept pressed upon the discharge roller 601 and is rotated by the rotation of the discharge roller 601. On the downstream side of the downstream platen 401, a recording medium conveyance roller 501 and a pinch roller 502 are disposed, which together constitute a first roller portion 500. The pinch roller 502 is held by a pinch roller holder 503 so that the pinch roller 502 is kept pressed upon the recording medium conveyance roller 501 and is rotated by the rotation of the recording medium conveyance roller 501. On the further downstream side of the recording medium conveyance roller 501, a recording medium guide 504 is disposed, which supports the recording medium P delivered thereto.

Next, referring to FIG. 2, how the recording medium P is conveyed as the recording medium P is fed into the ink jet printer 1 will be described. The recording mediums P are separated one by one by the feed roller 203 and separating mechanism 204 at the first position y1 while remaining pressed on the pickup roller 201 by the pressure plate 202 at the first position x1. Then, each recording medium P is guided to the second roller portion 600 by the flapper 211 having been pivoted upward. Then, the recording medium P is pinched by the discharge roller 601 and discharge pinch roller 602, and is conveyed, while being guided by the recording medium guide 504 and controlled, in conveyance distance, by a recording medium detecting means (unshown), to the position in which the very end of the trailing edge of the recording medium P is pinched by the recording medium conveyance roller 501 and pinch roller 502. This ends the recording medium feeding step, readying the recording medium P for recording.

Next, referring to FIG. 3, how the recording medium P is conveyed for recording on the recording medium P and discharging the recording medium from the ink jet printer 1 will be described. As described above with reference to FIG. 2, an actual recording operation is started, with the trailing edge of the recording medium P remaining gripped by the recording medium conveyance roller 501 and pinch roller 502, after the recording medium P is conveyed to its most downstream position. As the recording operation is started, the recording medium P is conveyed upstream by the recording medium conveyance roller 501 and pinch roller 502, being guided by the downstream and upstream platens 401 and 402 and facing the carriage 301 which carries the ink jet recording head, to the second roller portion 600, while recording is continuously made on the recording medium P. Then, the recording medium P is conveyed further upstream while remaining pinched by the discharge roller 601 and discharge pinch roller 602, and then, is guided by the flapper 211, which has pivoted downward, toward the second positions x2 and y2. Then, the recording medium P is discharged into the delivery tray 102.

As described before, according the prior art, as soon as the trailing end of the recording medium P is released from the grip of the discharge roller 601 and pinch roller 602, the recording medium P is not subjected to the force which acts to convey the recording medium P. In other words, the process of discharging the recording medium P ends with the trailing end of the recording medium P remaining in the immediate adjacencies of the pair of discharge rollers 601 and 602, and the recording medium P being still on the recording medium feeding mechanism. Therefore, it is possible for a paper jam or the like problems to occur. In comparison, according to the present invention, the recording medium P is moved past the second position y2, which is on the opposite side of the feed roller 203 from the first position y1, and then, the first position x2 which is on the opposite side of the pickup roller 201 from the first position x1, while remaining in contact with the feed roller 203 and pickup roller 201. Therefore, even after the recording medium P is freed from the recording medium conveying force of the discharge roller 601 and discharge pinch roller 602, being therefore not subjected to the force generated by the two rollers 601 and 602, it still remains subjected to the recording medium conveying force provided by the pickup roller 201 and feed roller 203. Therefore, it is ensured that the recording medium P is discharged into the delivery tray 102.

As long as the recording medium P is in contact with the pickup roller 201 and/or feed roller 203, it remains subjected to the recording medium conveying force from these rollers, because of the weight of the recording medium P itself. In this embodiment, moreover, the pickup roller 201 and feed roller 203, which are positioned close to each other in terms of the recording medium conveyance direction and function as recording medium conveyance rollers, are paired with the second discharge roller 205 and first discharge roller 208, which are kept pressed upon the pickup roller 201 and feed roller 203 and are rotated by their rotation, respectively. Therefore, it is ensured that the recording medium P is subjected to the recording medium conveyance force from the pickup roller 201 and feed roller 203, and therefore, it is ensured that the recording medium P is discharged into the delivery tray 102.

Next, referring to FIG. 3, the second discharge roller holder 206 is structured so that it can be rotated independently from the first discharge roller holder 209, about the shaft attached to the first discharge roller holder 209. Further, the second discharge roller holder 206 and first discharge roller holder 209 are kept independently pressed by the second discharge roller spring 207 and first discharge roller spring 210, respectively. Therefore, the recording medium conveyance force to which the recording medium P is subjected by the pickup roller 201 and feed roller 203 always remains at a level which is proportional to the rigidity of the recording medium P and compliant with the movement of the recording medium P.

Figure 4:
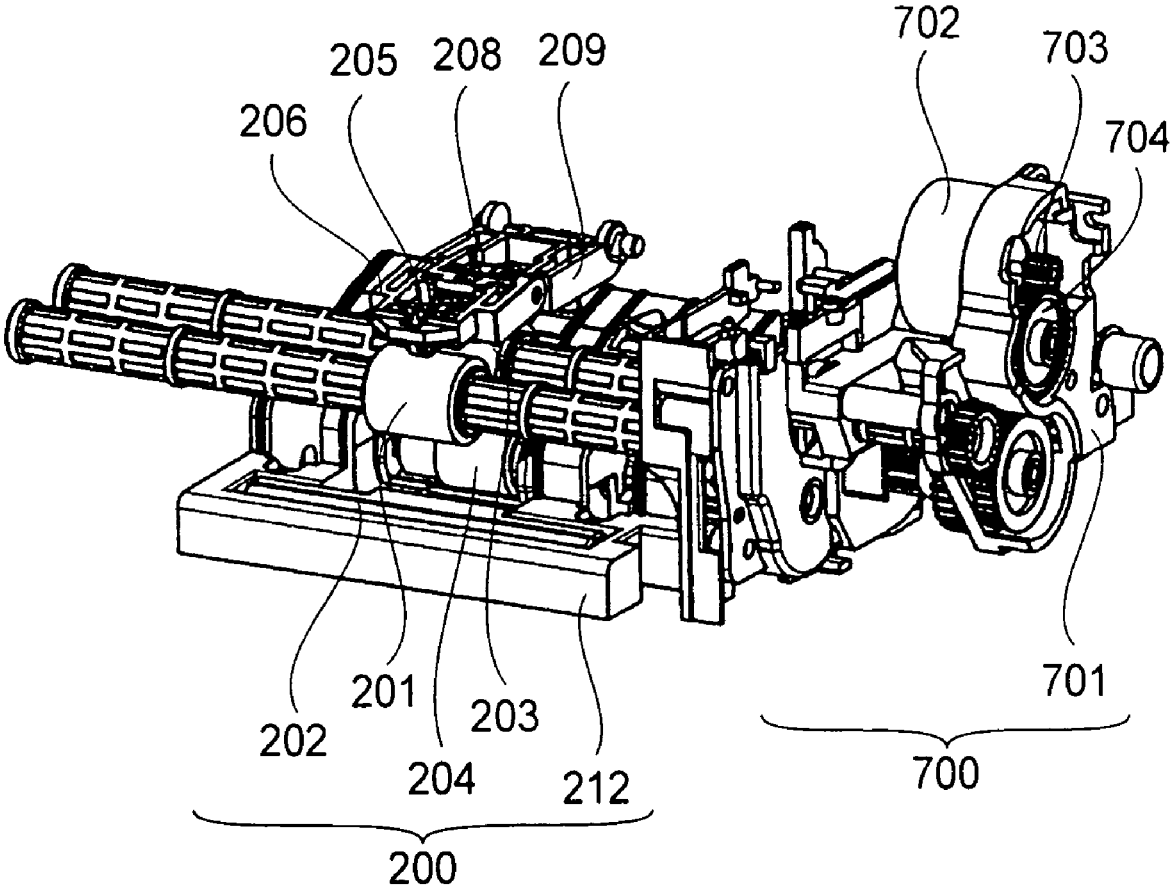
FIG. 4 is a side view the paper separating-feeding-discharging portion and driving force transmitting portion of the ink jet printer shown in FIG. 1, depicting the general structures thereof.

Next, referring to FIG. 4, the structure of the driving force transmitting portion will be described. FIG. 4 is a perspective view of the paper conveyance management portion 200 and driving force transmitting portion 700, showing the structures thereof.

As described before, the paper conveyance management portion 200 comprises the pickup roller 201, pressure plate 202, feed roller 203, and separation mechanism 204. It also comprises a paper feeding base 212, which supports the preceding components, and also, functions as a guide for the recording medium P. Further, the paper conveyance management portion 200 comprises the abovementioned pressing means made up of the second discharge roller 205, second discharge roller holder 206, first discharge roller 208, first discharge roller holder 209, etc. The driving force transmitting portion 700 comprises: a base 701 which supports the components of the driving force transmitting portion 700; a feeding/discharging motor 702 as a driving force source; and a driving force transmitting means such as a feeding/discharging motor gear 703, a driving force transmitting gear 704, and the like, which transmit the driving force.

The driving force transmitting portion 700 and paper conveyance management portion 200 are integrated, forming a single unit, and transmit the driving force from the driving force source to the paper conveyance management portion 200.

Next, referring to FIGS. 5-8, the driving force transmitting means described with reference to FIG. 4 will be described in detail.

Figure 5:
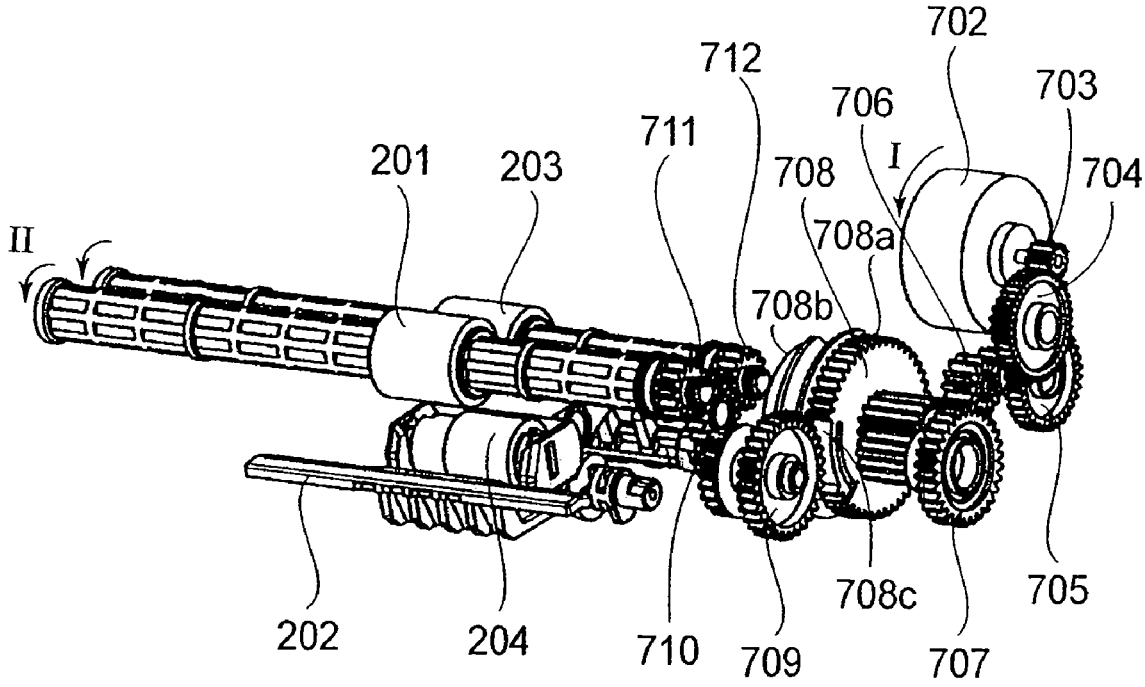
FIG. 5 is a partial perspective view of the paper separating-feeding-discharging portion and driving force transmitting portion of the ink jet printer shown in FIG. 1, showing a first driving force transmission path through which the driving force is transmitted from the driving force source to the paper separating-feeding-discharging portion.
Figure 6:
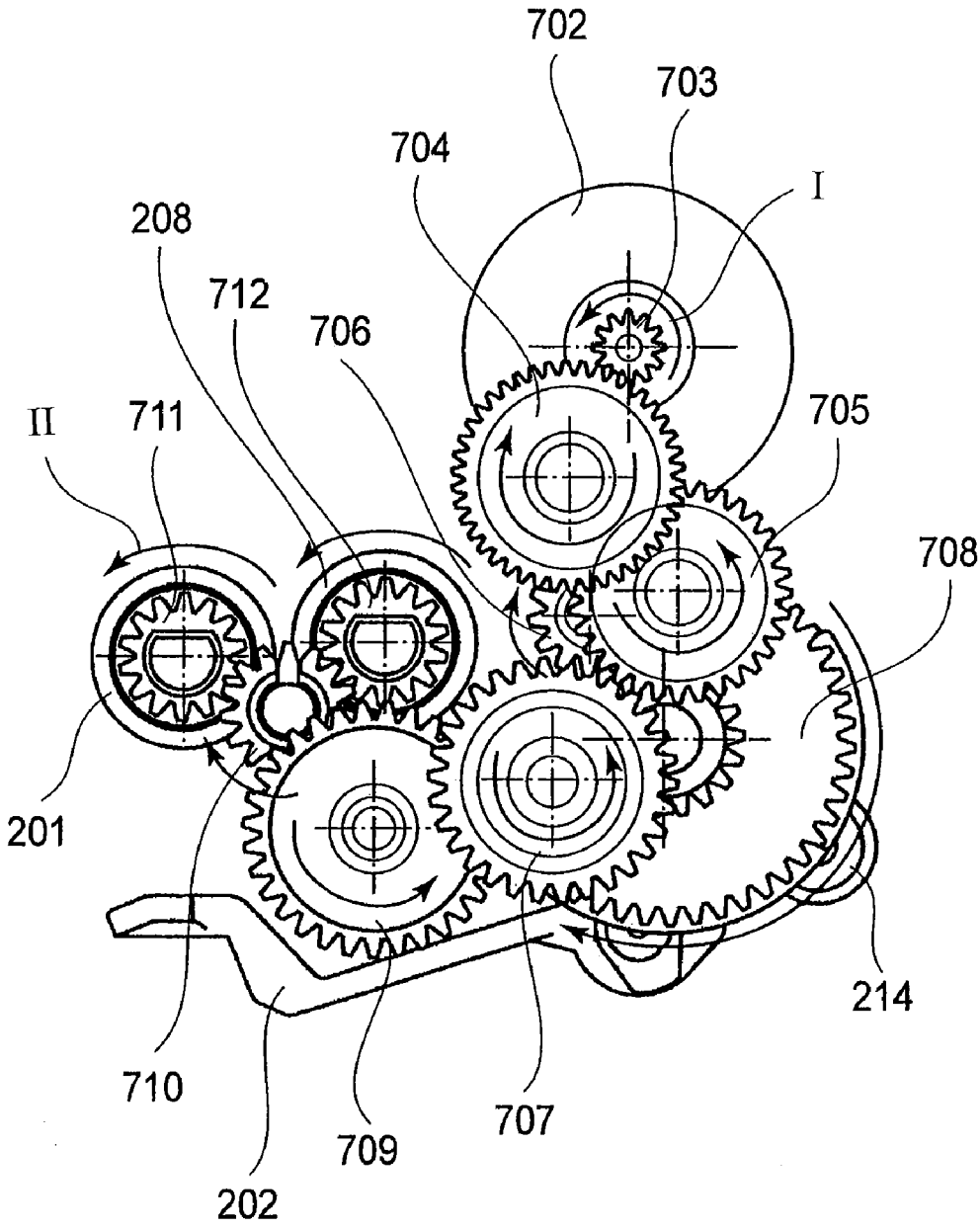
FIG. 6 is a partial side view of the paper separating-feeding-discharging portion and driving force transmitting portion of the ink jet printer shown in FIG. 1, showing the first driving force transmission path through which the driving force is transmitted from the driving force source to the paper separating-feeding-discharging portion.

FIG. 5 is a partial perspective view of the driving force transmitting portion, showing the only the components related to the first driving force transmission path, that is, the driving force path through which the driving force is transmitted from the driving force source to the paper conveyance management portion 200. FIG. 6 is a side view of the components of the first driving force transmission path, showing how the driving force is transmitted through the first driving force transmission path. The first driving force transmission path in FIGS. 5 and 6 corresponds to the driving force transmission path through which the driving force is transmitted for the feeding of the recording medium P.

The driving force generated by the feeding/discharging motor 702 as the driving force source is transmitted to a paper feed control cam 708 through the feeding/discharging motor gear 703, and driving force transmission gears 704, 705, 706, and 707.

The paper feed control cam 708 comprises a gear portion 708*a*, and a cam portion 708*b* having a predetermined profile. The gear portion 708*a* and cam portion 708*b* are supported by the same shaft. A recording paper feed control shaft 214 (FIG. 6) is provided with a cam follower (unshown) which follows the cam portion 708*b*. Referring to FIG. 2, in order to feed the recording medium P, the pressure plate 202 and separation mechanism 204 are pivoted upward by the function of the cam follower about the recording paper feed control shaft 214, and kept in the upward position, so that the leading end portion of the stack of recording mediums P, which is resting on the end portion of the pressure plate 202, is lifted by the pressure plate 202, being thereby pressed upon the pickup roller 201 and feed roller 203. This is how the paper feed control cam 708 puts the pressure plate 202 and separation mechanism 204 in motion through the recording paper control shaft 214 with predetermined timing. Incidentally, a structural arrangement other than the above described one may be employed, as long as the rotation of the paper feed control cam 708 can be converted into the force applied to the pressure plate 202 and the force for driving the separation mechanism.

A part of the driving force transmitted to the paper feed control cam 708 is transmitted, through the driving force transmission gears 709 and 710, to the pickup roller gear 711 connected to the pickup roller 201, and also, to the feed roller gear 712 connected to the feed roller 203. Thus, as the feeding/discharging motor 702 is rotated in the direction indicated by an arrow mark I (counterclockwise direction in drawings) as shown in FIGS. 5 and 6, the driving force is transmitted to the paper conveyance management portion 200 through the first driving force transmission path, rotating thereby the pickup roller 201 and feed roller 203 in the direction indicated by an arrow mark II (counterclockwise direction in drawings). As a result, the recording medium P is conveyed to the image recording portion 400.

The paper feed control cam 708 is structured so that while the paper feed control cam 708 rotates once, the above described recording paper separating and feeding operation is completed, and the recording medium P is conveyed into the main assembly of the ink jet printer 1. The gear 708*a* of the paper feed control cam 708 has a toothless portion 708*c*. The position at which this toothless portion 708*c* opposes the driving force transmission gear 709 corresponds to the home position of the paper feed control cam 708. Therefore, each time the operation for feeding a single recording medium P is completed by a single rotation of the paper feed control cam 708, the paper feed control cam 708 is in its home position, in which it is separated from the pickup roller 201, preventing the next recording medium P from being accidentally conveyed.

The driving force transmission gear 706 is provided with an unshown one-way clutch structured so that when the feeding/discharging motor 702 is rotated in the arrow mark I direction, the driving force is transmitted through the first driving force transmission path, but, when it is rotated in reverse (which will be described later), the driving force is not transmitted through the first driving force transmission path.

As described above, during the recording paper feeding operation, a predetermined amount of driving force is transmitted through the paper feed control cam 708, so that the recording mediums P are separated one by one, by being pressed upon the pressure plate 202 and separation mechanism 204, and are conveyed toward the image recording portion 400 by the pickup roller 201 and feed roller 203.

Figure 7:
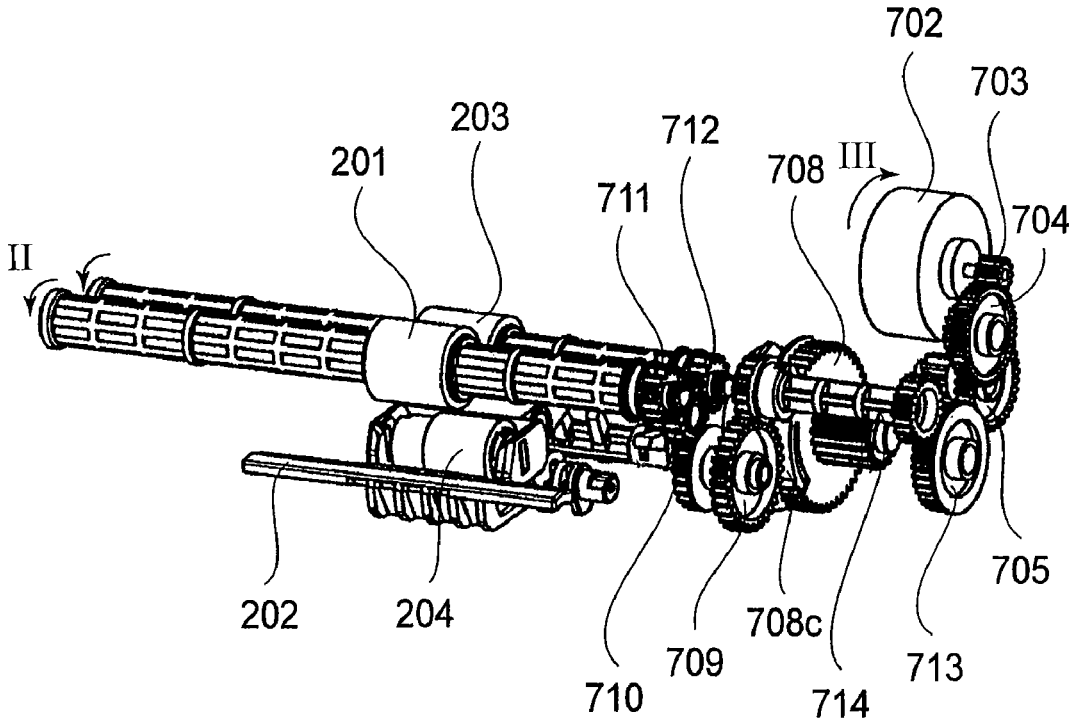
FIG. 7 is a partial perspective view of the paper separating-feeding-discharging portion and driving force transmitting portion of the ink jet printer shown in FIG. 1, showing a second driving force transmission path through which the driving force is transmitted from the driving force source to the paper separating-feeding-discharging portion.
Figure 8:
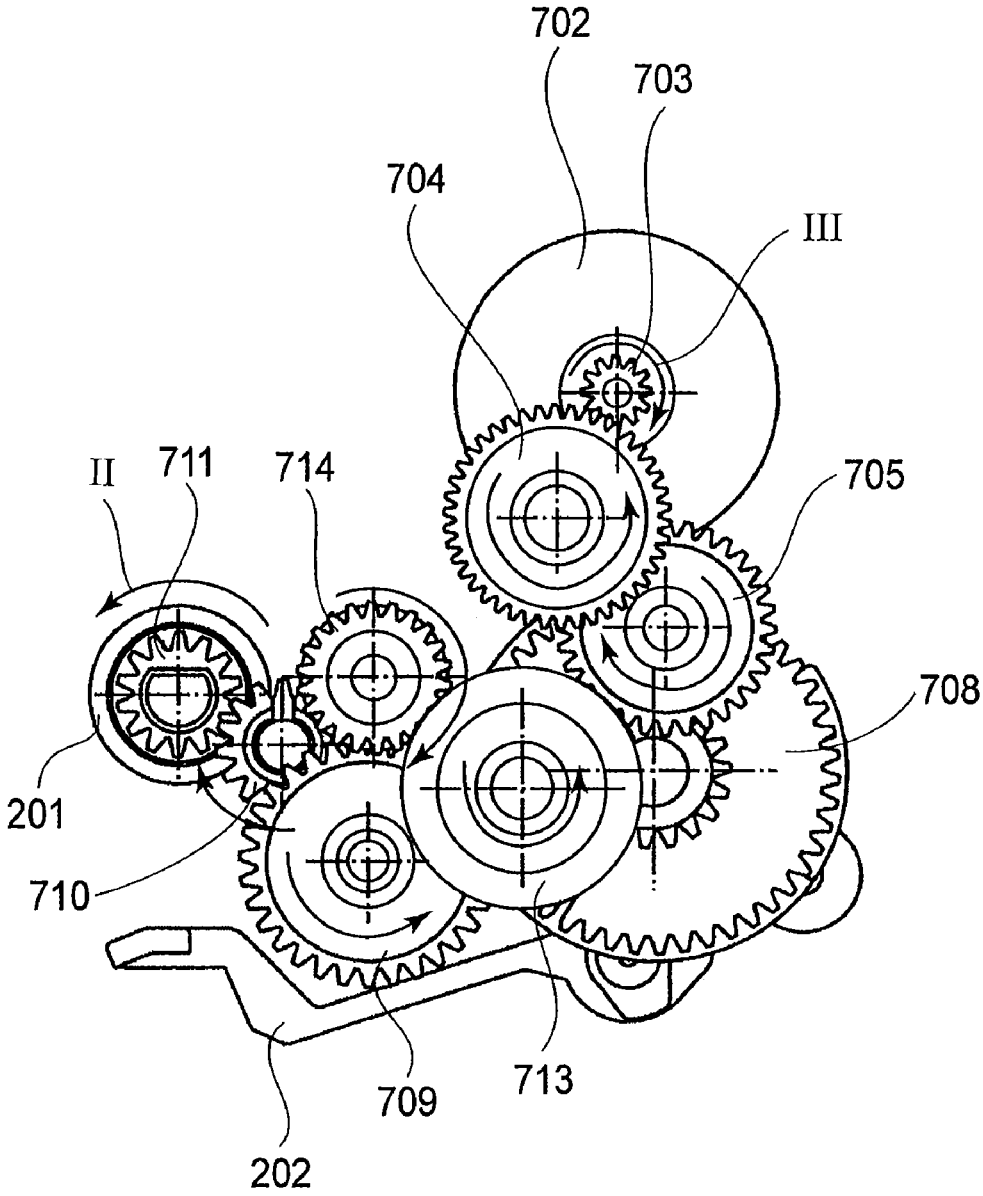
FIG. 8 is a partial side view of the paper separating-feeding-discharging portion and driving force transmitting portion of the ink jet printer shown in FIG. 1, showing the first driving force transmission path through which the driving force is transmitted from the driving force source to the paper separating-feeding-discharging portion.

FIG. 7 is a perspective view of the gist of the structural components of the second driving force transmission path, showing how the driving force is transmitted from the driving force source to the paper conveyance management portion 200. FIG. 8 is a side view of the driving force transmitting portion 700, showing how the driving force is transmitted to the paper conveyance management portion 200 through the second driving force transmission path. The second driving force transmission path corresponds to the driving force transmission path, shown in FIG. 3, through which the driving force is transmitted for recording an image and discharging the recording image P.

The driving force generated by the feeding/discharging motor 702 is transmitted to the feeding/discharging gear 705 through the feeding/discharging motor gears 703 and 704, and then, from the gear 705 to the driving force transmission gears 709 and 710 through the driving force transmission gears 713 and 714. Then, it is further transmitted to the pickup roller gear 711 connected to the pickup roller 201, and the feed roller gear 712 connected to the feed roller 203.

During this transmission of the driving force, the presence of the above described one-way clutch prevents the driving force from being transmitted to the driving force transmission gear 706. Therefore, it does not occur that the driving force is transmitted to the paper feed control cam 708 through the driving force transmission gear 706. Further, the feeding operation has already been completed. Therefore, the paper feed control cam 708 is in the home position, and therefore, there is no contact between the paper feed control cam 708 and pickup roller 201, preventing therefore the driving force transmitted to the paper feed control cam 708 through the driving force transmission gear 709.

Referring to FIGS. 7 and 8, with the provision of the above-described structural arrangement, as the feeding/discharging motor 702 is rotated in the direction indicated by an arrow mark III (clockwise direction in drawings), the driving force is transmitted through the second driving force transmission path. Therefore, the driving force rotates the pickup roller 201 and feed roller 203 (not shown in FIG. 8) in the direction indicated by an arrow mark II (counterclockwise direction in drawings) without moving the pressure plate 202 and separation mechanism 204. Further, the distance by which the recording medium P is conveyed by the pickup roller 201 and feed roller 203 can be controlled by adjusting the length of time the feeding/discharging motor 702 is driven, or another method.

The driving force transmission gear 714 is provided with an unshown one-way clutch structured so that when as the feeding/discharging motor 702 is rotated in the arrow III direction (FIG. 8), the driving force is transmitted through the second driving force transmission path, but, when it is rotated in the arrow mark I direction (FIG. 6), the driving force is not transmitted through the second driving force transmission path.

As described above, the first and second driving force transmission paths share the portions from the feeding/discharging motor 702 to the driving force transmitting gear 705, from which the driving force path branches into the actual first and second driving force transmission paths. More specifically, the first driving force transmission path branches from the driving force transmitting gear 705, goes through the driving force transmitting gears 706 and 707, paper feed control gear 708, and reaches the driving force transmitting gear 709, whereas the second driving force transmission path branches from the driving force transmitting gear 705, goes through the driving force transmitting gears 713 and 714, and reaches the driving force transmitting gear 709. From the driving force transmitting gear 709, the two driving force transmission paths share the same portion, and the driving force is transmitted to the pickup roller gear 711 and feed roller gear 712 through the driving force transmitting gear 710. Whether the first or second driving force transmission path is selected is automatically determined by whether the one-way clutch of the driving force transmitting gear 706 or the one-way clutch of the driving force transmitting gear 714 is activated.

Thus, whether the driving force is transmitted by way of the paper feed control cam 708 or not, in other words, whether the pressure plate 202 and separation mechanism 204 are moved or not, is determined by the rotational direction of the feeding/discharging motor 702. On the other hand, the pickup roller 201 and feed roller 203 are always driven in the same direction, that is, the counterclockwise direction, regardless of the rotational direction of the feeding/discharging motor 702, conveying thereby the recording medium P in the proper direction, that is, either in the direction to feed the recording medium P into the ink jet printer 1 or in the direction to discharge the recording medium P from the ink jet printer 1, based on whether the driving force is transmitted through the first or second driving force transmission path.

As will be evident from the above description of this embodiment of the present invention, with the employment of such a driving force transmission mechanism as that described above, the ink jet printer 1 in accordance with the present invention can transmit the driving force to the pickup roller 201 and feed roller 203 even during the operation for discharging the recording medium P, ensuring thereby that the recording medium P is completely discharged into the delivery tray 102.

Further, the paper conveyance management portion 200 is provided with the second and first discharge rollers 205 and 208, which are disposed so that they are pressed upon the pickup roller 201 and feed roller 203 at the second positions x2 and y2, respectively, and also, so that they are rotated by the rotation of the pickup roller 201 and feed roller 203, respectively. Therefore, the recording medium P is conveyed a sufficient distance by the driving force transmitted through the second driving force transmission path after the completion of the recording. Therefore, it is further ensured that the recording medium P is completely discharged into the delivery tray 102.

Further, this embodiment makes it unnecessary to increase the paper feed control cam 708 in external diameter in order to make it possible for the recording medium P to be completely discharged by only a single rotation of the cam 708, and also, makes it unnecessary to provide the paper conveyance management portion 200 with a switching means which is triggered by the carriage movement to interrupt or continue the movement of the paper feed control cam 708 during the feeding and discharging of the recording medium P, and a switching position therefor. Therefore, not only does this embodiment ensure that the recording medium P is properly fed into the ink jet printer 1 and is completely discharged therefrom, but also, makes it possible to reduce the ink jet printer 1 in size.

Figure 9:
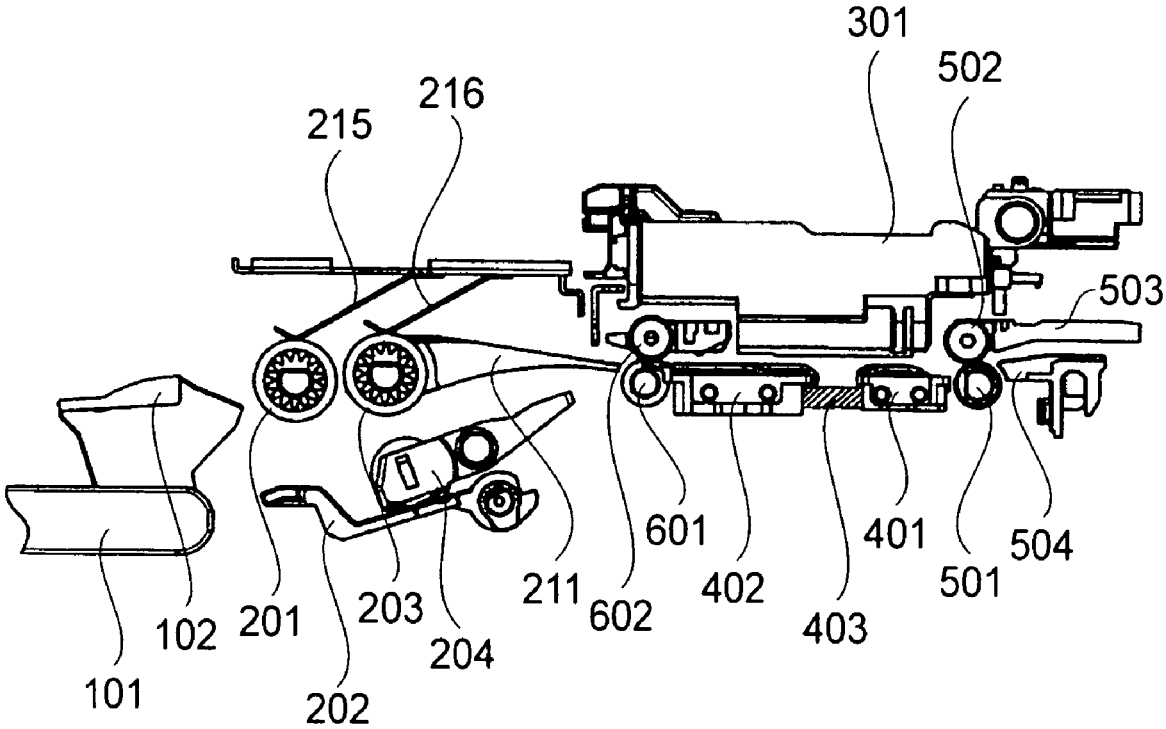
FIG. 9 is a side view of the essential portion of the ink jet printer in the second embodiment of the present invention, showing the general structure thereof.

Obviously, the above described embodiment of the present invention is not intended to limit the scope of the present invention. FIG. 9 is a schematic side view of the essential portion of the ink jet printer in the second embodiment of the present invention, depicting the gist of the second embodiment.

In this embodiment, flexible thin films 215 and 216 formed of polyethylene or the like are employed as the means for keeping the recording medium P pressed on the pickup roller 201 and feed roller 203. It is also feasible to employ a piece of flexible thin film as the means for keeping the recording medium P either on the pickup roller 201 or feed roller 203, and a roller as the means for keeping the recording medium P on the other. This embodiment of the present invention is particularly effective when the properties of the recording medium P and/or recording liquid (ink) make it not mandatory to keep the recording medium P pressed with the use of rollers. With the use of the flexible thin film, it is possible to further reduce the ink jet printer 1 in size, weight, and cost.

As described above, according to the present invention, it is possible to provide an image forming apparatus of the front loading- and front discharging type, which is not only smaller in size and superior in operability, but also, superior in terms of the reliability with which the recording medium P is fed and discharged.

Figure 10:
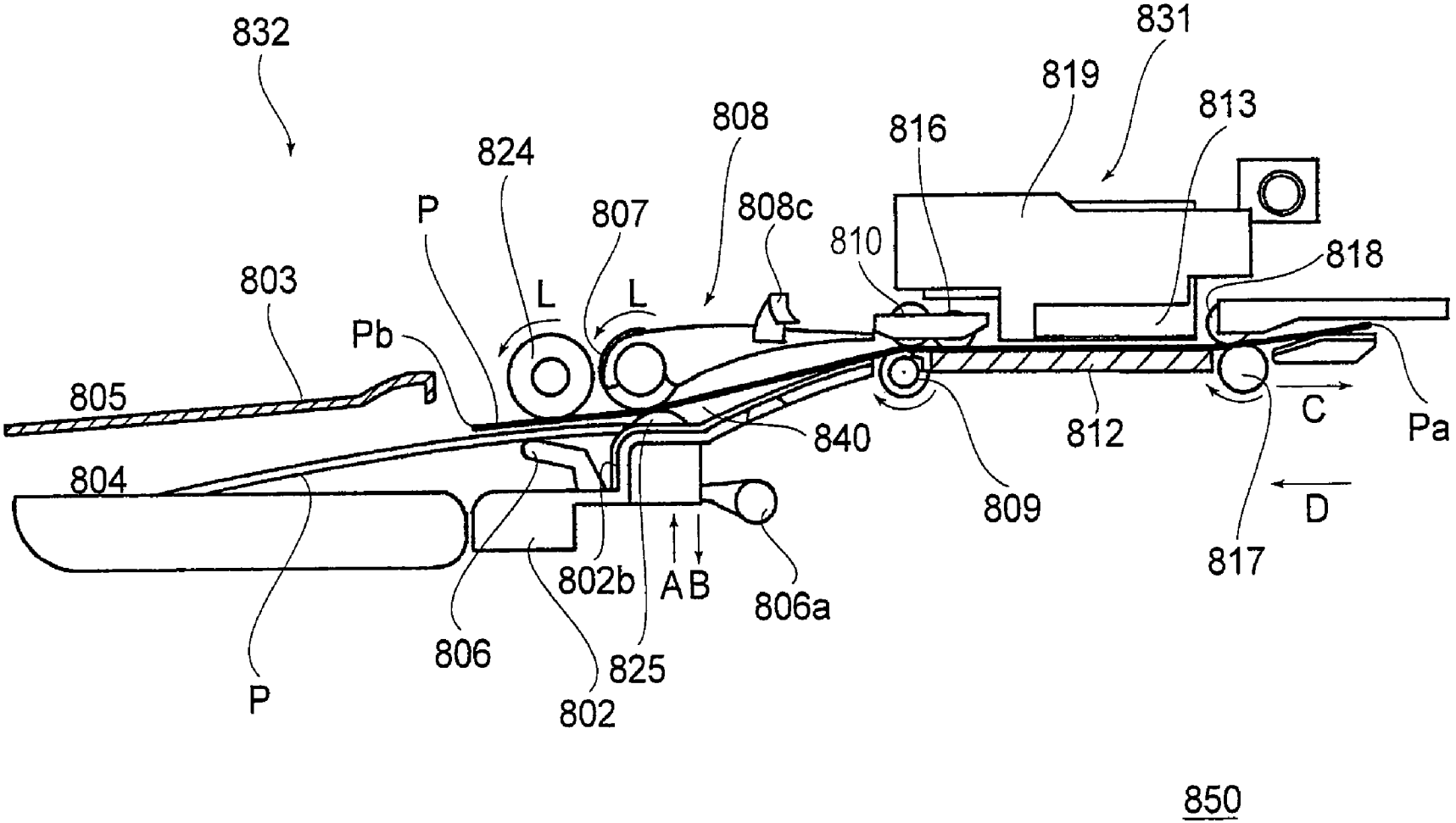
FIG. 10 is a sectional view of the essential portion of the ink jet printer in the third embodiment of the present invention, showing the general structure thereof.

FIG. 10 is a sectional view of the recording apparatus in the third embodiment of the present invention, showing the general structure thereof.

The recording apparatus 850 shown in FIG. 10 can be roughly divided into: a recording portion 831 (recording means) which ejects ink onto the recording medium P to form an image on the recording medium P; and a paper feeding/discharging tray portion 832, which is disposed next to the recording portion 831 to store a single or plurality of recording mediums P, and also, to catch the recording medium P after the completion of recording on the recording medium P.

The recording portion 831 has one of the generally known structures of this type of recording apparatus, and comprises:

a carriage 819 on which a recording head 813 is mounted, and which is reciprocally moved in the direction parallel to the width direction of the recording medium P; a platen 812 which supports the recording medium P while an image is formed on the recording medium P; and a recording medium conveying mechanism disposed in a manner of horizontally sandwiching the carriage 819.

The carriage 819 is structured so that it can be moved along with the guiding shaft in the direction perpendicular to the recording medium conveyance direction, that is, the direction parallel to the width direction of the recording medium P. The platen 812 is disposed so that it faces the surface of the recording head 813, which has the ejection orifices. With the employment of this structural arrangement, the space between the platen 812 and the surface of the recording head 813 having the ejection orifices constitutes a part of the recording medium conveyance path. The platen 812 is rendered wider than the width of the recording medium P so that the platen 812 can support the recording medium P across the entire width of the recording medium P.

As for the mechanism for conveying the recording medium P, it comprises a paper discharging roller 809 (which hereinafter will be referred to simply as discharge roller 809), which is disposed on the left side of the carriage 819 in FIG. 10, and a paper conveyance roller 817 (which hereinafter will be simply referred to as conveyance roller 817), which is disposed on the opposite side of the caffiage 819 from the discharge roller 809. The discharge roller 809 and conveyance roller 817 are disposed so that they both make contact with the back surface (bottom surface) of the recording medium P. Disposed above the conveyance roller 817 is a paper discharging pinch roller 818, which opposes the conveyance roller 817. With the employment of this structural arrangement, the discharge roller 809 and conveyance roller 817 are enabled to convey the recording medium P while pinching the recording medium P in coordination with the discharge pinch roller 810 and discharge pinch roller 818, respectively. In this embodiment, both the discharge roller 809 and conveyance roller 817 are structured so that they can be rotated forward or in reverse, making it possible to convey the recording medium P forward or in reverse. The recording medium P is conveyed either by both the discharge roller 809 and conveyance roller 817, or one of the two rollers. On the slightly downstream side of the discharge pinch roller 810, an auxiliary roller 816 is disposed, which is for pressing the recording medium P upon the top surface of the platen 812.

The feeding/discharging tray portion 832 has two vertically stacked portions, that is, the top and bottom portions separated by a partitioning plate 803. The bottom portion constitutes a feeder tray 804 in which a plurality of recording mediums P of a predetermined size are stored, and the top portion constitutes a delivery tray 805 into which the recording mediums P are discharged after recording.

Immediately next to the paper feeding/discharging tray portion 832, a paper feeding base 802 is disposed, which guides the recording medium P when feeding the recording medium P into the recording apparatus. The paper feeding base 802 is shaped so that it extends to the adjacencies of the discharge roller 809 to guide the leading edge Pa of the fed recording medium P to the recording portion 831, and the top surface of this paper feeding base 802 constitutes a paper discharging ramp 840 for sending the recording medium P outward. The paper feeding base 802 is provided with a pair of ribs 802*b*, which are positioned on the parts of the top or lateral surface of the base 802 to guide the recording medium P by coming into contact with the back surface (bottom surface) of the recording medium P.

The mechanism for drawing the recording mediums P, separating them one by one, and feeding them into the recording apparatus, is attached to this paper feeding base 802. Next, this mechanism will be described in more detail.

Of the various components of the paper feeding/discharging tray portions 832, disposed most upstream (leftward in drawing) in terms of the recording medium conveyance direction is a pickup roller 824, which is for conveying a few of the plurality of recording mediums P stored in the paper feeder tray 804. Below the pickup roller 824, a pressure plate 806 is disposed, which keeps the recording mediums P pressed on the underside of the pickup roller 824. The pressure plate 806 is hinged by a rotational shaft 806*a* at one end. Normally, the pressure plate 806 is kept under the pressure provided by an unshown pressure applying member in the direction to keep the recording medium P pressed upon the pickup roller 824. In order to free the recording mediums P from the pressure from the pressure plate 806, an unshown mechanism for lowering the pressure plate 806 is provided in the adjacencies of the pressure plate 806. This lowering mechanism is for lowering the pressure plate 806 against the pressure from the abovementioned unshown pressing member. As the lowering mechanism is driven as necessary, the pressure plate 806 descends, allowing thereby the recording medium P to separate from the pickup roller 824. As for the portion of the pressure plate 806, which directly opposes the pickup roller 824, it is rendered flat so that the recording medium P is pressed upon the pickup roller evenly across the width direction of the recording medium P.

On the right-hand side of the pickup roller 824 in the drawing, that is, the downstream side of the pickup roller 824, a paper feeding roller 807 is disposed virtually in contact with the pickup roller 824. Further, below the feed roller 807, a separation roller 825 is disposed, which pinches the recording medium P in coordination with the feed roller 807.

The pickup roller 824, feed roller 807, and separation roller 825 are all cylindrical, and their peripheral surfaces are covered with rubber or the like substance which is high in friction, so that the recording medium P is efficiently conveyed. The pickup roller 824 and feed roller 807 are virtually the same in external diameter. Of these three rollers 824, 807, and 825, the pickup roller 824 and feed roller 807 are simultaneously driven by the same driving power source, which will be described later. As for the separation roller 825, it is not rotationally driven. It is simply kept pressed toward the feed roller 807 by the unshown pressure applying means, so that it pinches the recording medium P in coordination with the feed roller 807. Further, the separation roller 825 is given the function of a torque limiter.

By the combination of the functions of these rollers 824, 807, and 825, the recording mediums P are separated one by one, and fed into the printer, as will be described next.

First, a plurality (inclusive of single) of recording mediums P are to be set in the recording medium feed tray 804. As they are fed into the tray 804, they are pressed toward the pickup roller 824 by the pressure plate 806. As a result, the topmost recording medium P is pressed on the underside of the pickup roller 824. The pickup roller 824 is rotated in this state in the direction indicated by an arrow mark L in the drawing. As the pickup roller 824 is rotated, a few recording mediums P inclusive of the topmost recording medium P are conveyed together, causing the leading ends of the recording mediums P to be placed between the feed roller 807 and separation roller 825. As a result, the topmost recording medium P is separated by the feed roller 807 and separation roller 825 from the few recording mediums P between the feed roller 807 and separation roller 825, and then, is conveyed toward the recording portion 831. Through the above described sequential steps, only the topmost recording medium P is separated from the plurality of recording mediums P stored in the recording medium feed tray 804 and is fed into the recording portion 831. Incidentally, in FIG. 10, the direction in which the recording medium P is fed is indicated by an arrow mark C.

Next, the flapper 808, which characterizes the present invention, will be described with respect to its structure and movement.

Figure 11:
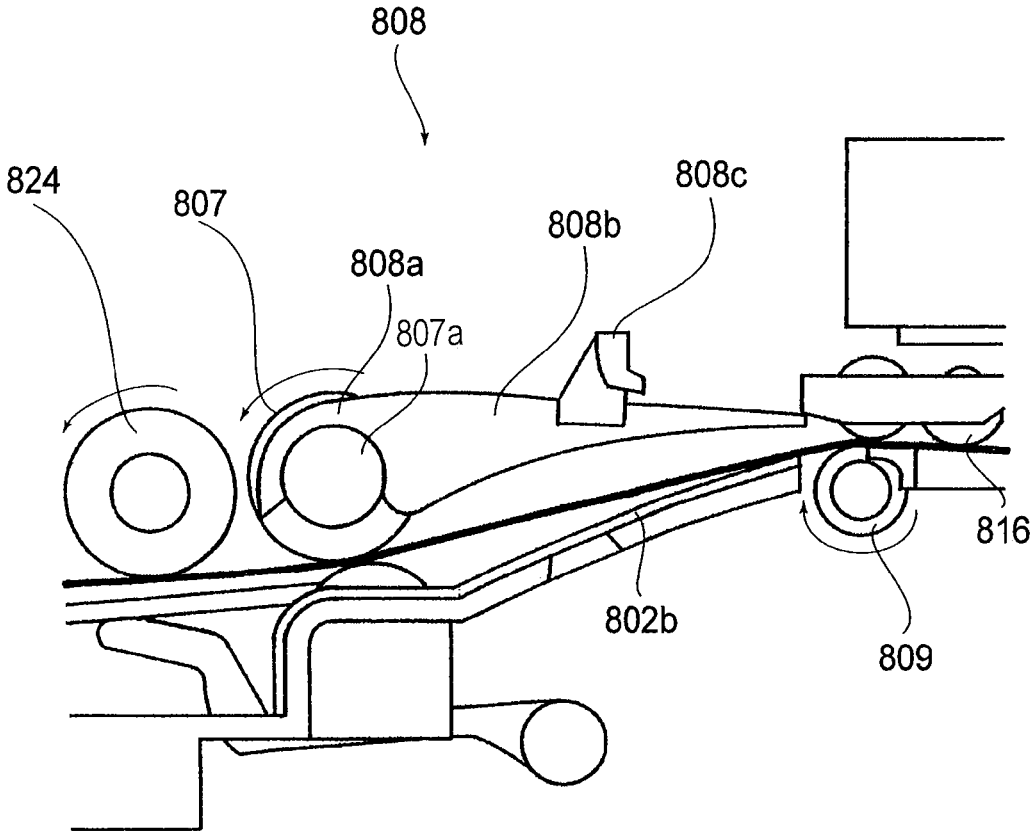
FIG. 11 is an enlarged side view of the flapper of the ink jet printer in FIG. 10, showing the structure thereof.

Referring to FIG. 11, the flapper 808 is made up of a pivotal base portion 808*a* and a flapper proper 808*b*. The pivotal base portion 808*a* is pivotally supported by the shaft 807*a*, which also supports the feed roller 807. The pivotal base portion 808*a* is not solidly fixed to the shaft 807*a*. Therefore, even when the shaft 807*a* is rotated to rotate the feed roller 807, the flapper 808 does not rotate with the shaft 807*a*. The flapper proper 808*b* is in the form of a tongue, extending from the pivotal base portion 808*a* to the adjacencies of the above described discharge roller 809 of the recording portion 831. With the employment of this structural arrangement, the flapper 808 can be made to pivot upward or downward about the shaft 807*a* so that the flapper proper 808*b* opens or closes a recording medium inlet 840 as a part of the recording medium conveyance path.

In order to prevent the bottom surface of the flapper proper 808*b* from contacting the top surface of the recording medium P when the flapper 808 is in the top position, the flapper proper 808*b* is structured so that as the flapper 808 is pivoted upward, a sufficient amount of space is created between the top surface of the paper feeding base 802 and the bottom surface of the flapper proper 808*b*. With the employment of this structural arrangement, the bottom surface of the flapper proper 808*b* does not contact the recording medium P when the recording medium P is fed into the printer. Therefore, the recording medium P is not damaged by the flapper proper 808*b* when it is fed into the printer. Further, the flapper proper 808*b* is structured so that after the downward pivoting of the flapper 808*b* (when it is in the bottom position), the top surface of its end portion is below the highest point of the discharge roller 809. With the employment of this structural arrangement, when the recording medium P is discharged from the printer, the trailing end Pb (in terms of recording medium feeding direction) of the recording medium P smoothly slides onto the top surface of the flapper proper 808*b*. The discharging of the recording medium P will be described later.

The cam follower 808*c* of the flapper 808, which is located roughly at the mid point between the base and end portions of the flapper proper 808*b*, is in contact with the cam of the driving portion, which will be described later. With the employment of this structural arrangement, as the cam is rotated, the flapper 808 is pivoted upward or downward. The flapper proper 808*b* is rendered wider than the width of the recording medium. The cam follower 808*c* is attached to one of the edges of the flapper proper 808*b* in terms of the widthwise direction of the flapper proper 808*b*. Therefore, it does not occur that the recording medium P interferes with the cam follower 808*c* when it is fed into, or discharged from, the recording apparatus.

Figure 12:
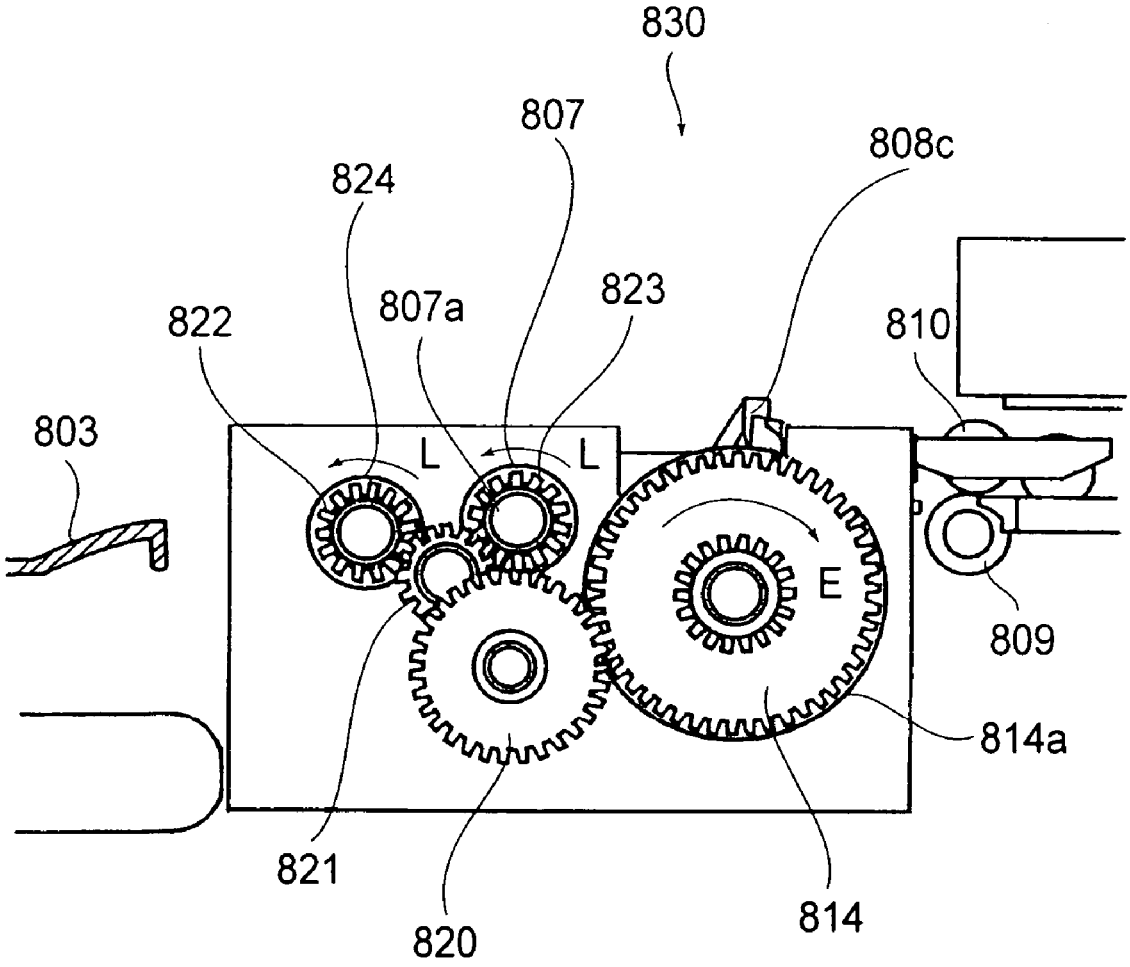
FIG. 12 is an enlarged schematic side view of the driving portion, showing the structure thereof.
Figure 13:
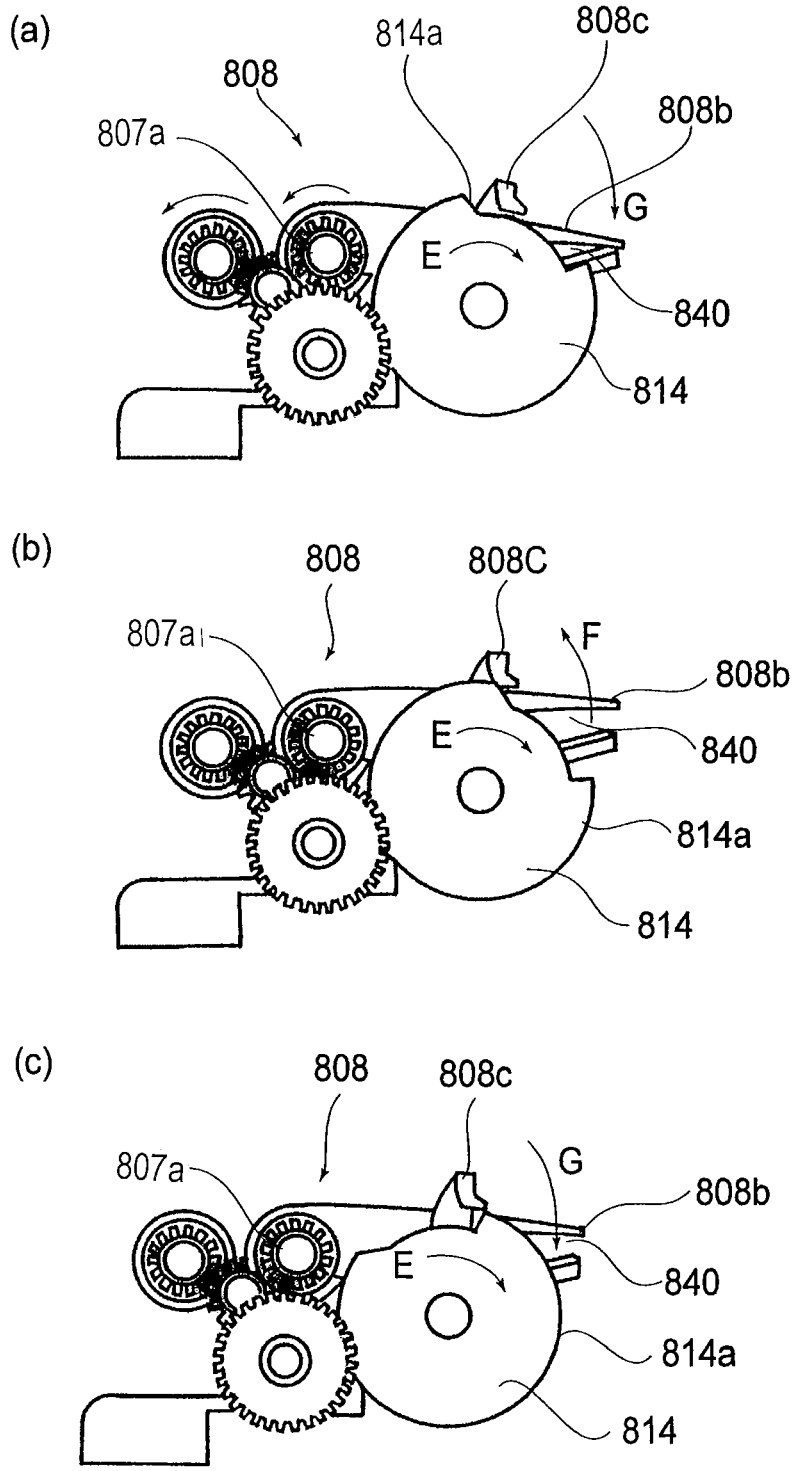
FIG. 13 is a drawing for describing the pivotal movement of the flapper caused by the driving portion.

Next, referring to FIGS. 12 and 13, the driving portion for making the flapper 808 pivot upward or downward will be described. FIG. 12 is an enlarged view of the driving portion, showing the structure thereof. FIG. 13 is a drawing for sequentially depicting the upward and downward pivotal movements of the flapper 808 which occur as the flapper 808 is made to pivot by the driving portion.

Referring to FIG. 12, the driving portion 830 is located in the adjacencies of the pickup roller 824 and feed roller 807, which are for feeding the recording mediums P into the printer while separating them. It has a plurality of gears, including a control gear 814.

The control gear 814 is solidly attached to the rotational shaft, which is rotationally driven by an unshown driving force source such as an electrical motor or the like. As for the position of this rotational shaft, it is below the cam follower 808*c* of the above described flapper 808. The control gear 814 has a gear portion having a plurality of teeth for transmitting the rotational driving force therefrom, and a cam portion 814*a* for pivotally moving the flapper 808 by coming into contact with the cam follower 808*c*. The cam portion 814*a* has a large diameter portion for pivoting the flapper 808 upward, and a small diameter portion for allowing the flapper 808 to pivot downward. The peripheral surfaces of the large and small diameter portions are rendered arcuate, and are coaxial with the shaft which supports the control gear 814. The small diameter portion exists as if it is a tiny portion of the large diameter portion which constitutes the major portion of the cam portion 814*a*. When the cam follower 808*c* is following the small diameter portion, the flapper 808 is in the bottom position.

The rotational driving force from the control gear 814 is transmitted through a double gear 820 and an idler gear 821, and then, to a pickup roller gear 822 and feed roller gear 823, both of which are meshed with an idler gear 821. The pickup roller gear 822 and feed roller gear 823 are attached to the shafts of the pickup roller 824 and feed roller 807, respectively, and their pitch diameters are the same as those of the pickup roller 824 and feed roller 807, respectively. Therefore, as the control gear 814 is rotated, for example, in the direction indicated by an arrow mark E in the drawing, the driving force therefrom is transmitted to the double gear 820 and idler gear 821, which in turn simultaneously rotate the pickup roller 824 and feed roller 807 in the direction indicated by an arrow mark L at the same rotational velocity.

Next, referring to FIG. 13, the upward and downward pivoting of the flapper 808 will be described.

FIG. 13(*a*) shows the positional relationship between the cam follower 808*c* and cam portion 814*a* of the control gear 814, in which the cam follower 808*c* is in contact with the small diameter portion of the cam portion 814*a*. When the cam follower 808*c* and cam portion 814*a* are in this positional relationship, the flapper proper 808*b* of the flapper 808 has pivoted downward (direction indicated by arrow mark G in drawing) due to its own weight, having thereby shut, by its end, the recording medium inlet 840 as a part of the recording medium conveyance path. As will be evident from the drawing, the diameter of the small diameter portion of the cam portion 814*a* is set so that after the shutting of the recording medium inlet 840 by the end of the flapper proper 808*b*, the bottom end of the cam follower 808*a* does not contact the peripheral surface of the small diameter portion of the cam portion 814*a*.

Next, referring to FIG. 13(*b*), as the control gear 814 is further rotated in the arrow mark E direction, the cam follower 808*c* slides onto the large diameter portion of the cam portion 814*a*, pushing thereby the flapper 808 upward. As a result, the flapper 808 is made to pivot upward (direction indicated by arrow mark F), opening therefore the recording medium inlet 840.

Next, referring to FIG. 13(*c*), as the control gear 814 is further rotated in the arrow mark E direction, the cam follower 808*a* slides down onto the small diameter portion of the cam portion 814*a* from the large diameter portion, allowing thereby the flapper 808 to pivot downward (arrow mark G direction), shutting thereby the recording medium inlet 840.

Next, referring to FIG. 14, the operation of the recording apparatus 850 in this embodiment, which is structured as described above, will be described.

Figure 14:
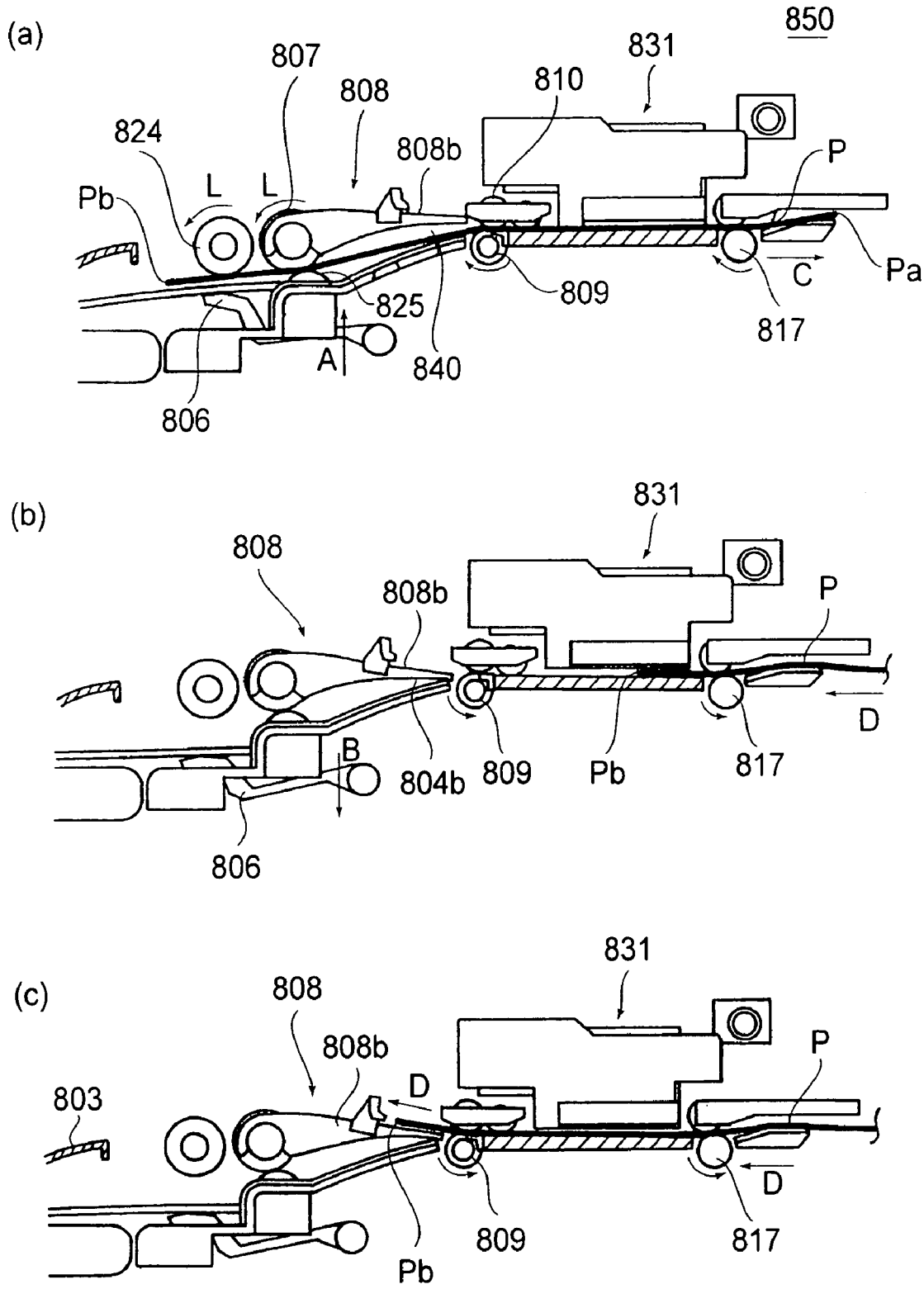
FIG. 14 is a drawing for describing the recording operation carried out by the recording apparatus shown in FIG. 10.

First, referring to FIG. 14(*a*), a single or plurality of recording mediums P are set in the feeder tray 804. As the recording mediums P are set, the topmost recording medium P of the plurality of recording mediums P is pressed upon the bottom end of the pickup roller 824 by the pressure plate 806. Then, the driving portion 830 begins to be driven to simultaneously drive the pickup roller 824 and feed roller 807. As the driving portion is driven, first, a few recording mediums P including the topmost one are conveyed together by the pickup roller 824 toward the feed roller 807, causing the leading ends of the plurality of recording mediums P to be placed between the feed roller 807 and separation roller 825. As a result, the topmost recording medium P is separated from the rest by the coordination between the feed roller 807 and separation roller 825, and is conveyed toward the recording portion 831. At this time, the flapper 808 is in the top position, keeping thereby the recording medium inlet 840 open.

As the leading end Pa of the recording medium P reaches the discharge roller 809, it is pinched by the discharge roller 809, and the discharge pinch roller 810 which opposes the discharge roller 809. Thus, as the discharge roller 809 is rotated in the direction indicated by an arrow mark in the drawing, the recording medium P is conveyed between the recording head 813 and platen 812, and is conveyed further in the direction indicated by an arrow mark C in the drawing. FIG. 14(*a*) shows the state of the paper conveyance management portion, in which the leading end Pa of the recording medium P has just moved past the conveyance roller 817 while being moved inward of the recording apparatus.

Next, referring to FIG. 14(*b*), this operation of feeding the recording medium P inward of the recording apparatus is continued until the trailing end Pb of the recording medium P reaches the predetermined recording start position past the flapper 808. After the completion of this recording medium feeding operation, the flapper 808 is made to pivot downward by driving the driving portion 830, shutting thereby the recording medium inlet 840. When the flapper 808 is in this condition, its end portion is positioned slightly lower than the highest point of the peripheral surface of the discharge roller 809 in terms of the vertical direction of the recording apparatus. Further, the pressure plate 806 is displaced downward by driving the unshown pressure plate lowering mechanism. As a result, the plurality of recording mediums P upwardly held by the pressure plate 806 become separated from the pickup roller 824. Regarding the timing of this lowering of the pressure plate 806, the pressure plate 806 may be lowered the moment the leading end Pa of the recording medium P is pinched by the discharge roller 809 and discharge pinch roller 810 shown in FIG. 14(*a*).

After the recording medium P is conveyed to the predetermined recording start position, the inward conveyance of the recording medium P is stopped, and the actual recording operation is started. In other words, the carriage 819 of the recording portion 831 is moved in the width direction of the recording medium P, with the recording medium P kept stationary, while causing the recording head 813 to eject ink in accordance with image formation data. As a result, a portion of an intended image, which corresponds to a singe scanning run of the recording head 813, is formed on the recording medium P. Next, the recording medium P is conveyed by a predetermined distance in the direction indicated by an arrow mark D in the drawing by rotating the feed roller 817 in the direction opposite to the direction in which it was rotated during the recording medium feeding operation. Then, another portion of the intended image, which corresponds to a single scanning run of the recording head 813 is formed on the recording medium P. This sequence of conveying the recording medium P by a predetermined distance and recording a specific portion of the intended image is repeated until the intended image is completed on the recording medium P.

As the above described recording sequence is continuously repeated, the recording medium P is discharged in the arrow mark D direction as shown in FIG. 14(*c*). During this period, the flapper 808 is in the bottom position. Therefore, as the trailing end Pb of the recording medium P in terms of the recording medium feeding direction is moved past the discharge roller 809, it slides onto the top surface of the flapper 808. Thus, the recording medium P is thereafter guided by the top surface of the flapper 808, and is discharged onto the delivery tray 805 partitioned from the feeder tray 805 by the partitioning plate 803.

Through the series of above described steps, a desired image is formed on the recording medium P fed into the recording apparatus from the feeder tray 804. Then, after the completion of the recording the desired image on the recording medium P, the recording medium P is discharged into the delivery tray 805 through the last portion, that is, the recording medium delivery portion, of the recording medium path, to which the recording medium path is switched by the flapper 808.

As described above, in this embodiment of the present invention, the flapper 808 of the recording apparatus 850, which is for switching the recording medium conveyance path, is made to pivot by the driving portion 830. Therefore, the flapper 808 can be kept in the top position for the duration of the recording medium feeding operation. Also in this embodiment, the flapper 808 is structured so that when the flapper 808 is in the top position, the bottom surface of the flapper 808 does not contact the recording surface of the recording medium P. Therefore, it is prevented that the recording medium P is damaged while the recording medium is fed into the recording apparatus. Further, in this embodiment, the driving portion 830 is structured so that the pickup roller 824 and feed roller 807 are rotated by the rotational driving of the control gear 814, and also, so that the flapper 808 is made to pivot upward or downward by the rotation of the cam portion 814*a*. Further, the control gear 841 and cam portion 841*a* are supported by the same shaft. Therefore, the pickup roller 824, feed roller 807, and flapper 808 can be simultaneously driven by rotating this shaft by a single driving force source (electric motor or the like). In other words, according to the present invention, a single driving force source can be shared for a plurality of purposes, making it possible to simplify a recording apparatus in structure as well as control, compared to a recording apparatus in accordance with the prior art, the various components of which are individually driven. In this case a recording apparatus in accordance with the present invention, the driving portion 830 is desired to be structured so that the pivotal movement of the flapper 808 and feeding of the recording medium by the pickup roller 824, etc., are tied to each other. In this embodiment, for example, the cam portion 814*a* is optimally shaped according to such factors as the external diameter of the pickup roller 834 and/or characteristics of the gear train, etc., so that until the completion of the feeding of each recording medium P, the flapper 808 is kept in the top position. Mechanically tying the operation of a given component to that of another makes it unnecessary to individually control a plurality of driving portions for individually driving various components. In other words, this embodiment can simplify a recording apparatus in terms of the control of the driving portion.

Incidentally, in the above, the preceding embodiment was described with reference to a recording apparatus of the type in which a single recording medium P was separated from a plurality of recording mediums P with the use of the combination of the feed roller 807 and separation roller 825. However, the preceding embodiment is not intended to limit the application of the present invention to a recording apparatus having the above described recording medium separation system. Further, not only is the present invention applicable to a recording apparatus, but also, a scanner or the like equipped with a recorded image reading apparatus.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Applications Nos. 145071/2004 and 171279/2004 filed May 14, 2004 and Jun. 9, 2004, respectively which are hereby incorporated by reference.

What is claimed is:

1. An ink jet recording apparatus comprising:

a sheet feeding tray for stacking a plurality of recording materials before recording;

a sheet discharge tray for stacking the recording material discharged after completion of the recording;

an image recording portion including an ink jet recording head and a platen for supporting the recording material so as to face said ink jet recording head;

a sheet feeding roller for contacting a surface of the recording material to be subjected to recording and feeding the recording material stacked on said sheet feeding tray to said image recording portion, and for contacting a backside surface of the recording material having been subjected to the recording and feeding the recording material to said sheet discharge tray;

a first roller portion for feeding the recording material;

a second roller portion, disposed at a position between said sheet feeding tray and said image recording portion and across said image recording portion from said first roller portion, for feeding the recording material; and a guiding member disposed between said sheet feeding roller and said second roller portion and movable between a first position for permitting feeding of the recording material toward said image recording portion, and a second position for feeding the recording material having been subjected to the recording to the sheet discharge tray, wherein after the recording material fed from said sheet feeding tray is passed between said ink jet recording head and said platen and is nipped by said first roller portion, the recording is carried out when the recording material is fed in an opposite direction between said ink jet recording head and said platen.

2. An apparatus according to claim 1, further comprising separating means for contacting the sheet feeding roller to separate the recording material, and a driving source transmitting portion including a driving source for generating a driving force for driving said sheet feeding roller and said separating means, a first path for transmitting the driving force to said sheet feeding roller and said separating means and a second path for transmitting the driving force only to said sheet feeding roller without transmitting the driving force to said separating means.

3. An apparatus according to claim 2, wherein said driving source includes a motor, wherein when the motor rotates in a first direction, the first path is selected, and when the motor rotates in a direction opposite the first direction, the second path is selected.

4. An apparatus according to claim 2, wherein said driving force transmitting portion rotates said sheet feeding roller in the same direction irrespective of whether the first or second path is selected.

5. An apparatus according to claim 1, further comprising urging means for urging the recording material having been subjected to the recording operation to said sheet feeding roller.

6. An apparatus according to claim 5, wherein said urging means comprises a roller member driven by a same driving source that drives said sheet feeding roller.

7. An apparatus according to claim 1, further comprising a pickup roller for picking up the recording material stacked on said sheet feeding tray at a position upstream of said sheet feeding roller with respect to a recording material feeding direction.

8. An apparatus according to claim 1, wherein said ink jet recording head forms the image by ejecting ink onto the recording material.

9. An apparatus according to claim 1, further comprising driving means for moving said guiding member between the first position and the second position.

10. An apparatus according to claim 9, wherein said guiding member is out of contact with the recording material in the first position.

11. An apparatus according to claim 9, wherein said driving means for moving said guiding member is driven by a driving source for driving said sheet feeding roller.

12. An apparatus according to claim 11, wherein said guiding member is moved in interrelation with a sheet feeding operation of said sheet feeding roller.

13. An apparatus according to claim 9, wherein said driving means includes a cam member for moving said guiding member.

* * * * *